US008550437B2

(12) United States Patent
Liou

(10) Patent No.: US 8,550,437 B2
(45) Date of Patent: Oct. 8, 2013

(54) TOOL WITH WORKING AND POSITIONING DEVICES

(76) Inventor: Mou-Tang Liou, Taichung (TW)

( * ) Notice: Subject to any disclaimer, the term of this patent is extended or adjusted under 35 U.S.C. 154(b) by 0 days.

(21) Appl. No.: 13/470,803

(22) Filed: May 14, 2012

(65) Prior Publication Data

US 2012/0223279 A1 Sep. 6, 2012

Related U.S. Application Data

(63) Continuation-in-part of application No. 12/139,560, filed on Jun. 16, 2008, now Pat. No. 8,177,191, and a continuation-in-part of application No. 12/371,648, filed on Feb. 16, 2009, now Pat. No. 8,201,806, and a continuation-in-part of application No. 13/426,751, filed on Mar. 22, 2012.

(51) Int. Cl.
*B21F 9/00* (2006.01)

(52) U.S. Cl.
USPC ..... 254/250; 254/25; 254/115; 254/130; 81/129.5; 81/144; 81/145

(58) Field of Classification Search
USPC ..... 254/25, 115, 130, 250; 81/129.5, 144, 81/145
See application file for complete search history.

(56) References Cited

U.S. PATENT DOCUMENTS

| | | | | |
|---|---|---|---|---|
| 404,001 | A | 5/1889 | Heacock | |
| 540,967 | A | 6/1895 | Eveleth | |
| 780,305 | A * | 1/1905 | Riggin | 81/144 |
| 856,097 | A | 6/1907 | Palmer | |
| 885,363 | A * | 4/1908 | Myers | 81/145 |
| 1,132,879 | A | 3/1915 | Rairden | |
| 1,402,470 | A | 1/1922 | Bauer | |
| 2,638,244 | A | 5/1953 | Baisch | |
| 2,643,854 | A | 6/1953 | Johnson | |
| 2,804,109 | A | 8/1957 | Fatica | |
| 2,876,776 | A | 3/1959 | Williams | |
| 3,219,316 | A | 11/1965 | Fried | |
| 3,629,883 | A | 12/1971 | Norman | |
| 3,852,839 | A | 12/1974 | Blessing | |
| 5,044,033 | A | 9/1991 | Fosberg | |
| 5,249,776 | A | 10/1993 | Johnson | |
| 5,280,738 | A | 1/1994 | Liou | |
| 5,845,354 | A | 12/1998 | Long et al. | |
| 5,871,204 | A | 2/1999 | Spirer | |
| 6,058,814 | A | 5/2000 | Johnson | |
| 6,827,333 | B1 | 12/2004 | Lutz | |
| 7,025,331 | B2 | 4/2006 | Whelan | |

(Continued)

*Primary Examiner* — Lee D Wilson
*Assistant Examiner* — Shantese McDonald
(74) *Attorney, Agent, or Firm* — Alan Kamrath; Kamrath IP Lawfirm, P.A.

(57) ABSTRACT

A tool includes a handle, a working device, a positioning device, a clamping device, and a fine adjustment mechanism. The handle includes a pivotal end, a grip end, and a plurality of retaining sections. The working device is pivotally connected to the pivotal end of the handle. The positioning device is moveable between a fixing position and an adjusting position. The clamping device is adjustably positioned on the handle. The fine adjustment mechanism for fine adjusting the clamping device is adjustably positioned on the handle and engaged with the clamping device. The fine adjustment mechanism includes at least one positioning unit alternatively engaged with a selective one of the plurality of retaining sections to fix the clamping device to the handle in position. The clamping device is adapted to be fine adjustably moved through a distance smaller than a pitch between two adjacent retaining sections.

20 Claims, 9 Drawing Sheets

(56) References Cited

U.S. PATENT DOCUMENTS

| | | | | |
|---|---|---|---|---|
| 7,063,168 | B2 | 6/2006 | Paloheimo et al. | |
| 7,278,626 | B1 | 10/2007 | Chang | |
| 7,735,172 | B2 | 6/2010 | Newton et al. | |
| 7,774,882 | B2 | 8/2010 | Liou | |
| 8,177,191 | B2 * | 5/2012 | Liou | 254/25 |
| 8,201,806 | B2 | 6/2012 | Liou | |
| 2004/0045416 | A1 | 3/2004 | Liou | |
| 2009/0008614 | A1 | 1/2009 | Adams et al. | |
| 2009/0050861 | A1 | 2/2009 | Noah et al. | |
| 2009/0307847 | A1 | 12/2009 | Liou | |
| 2010/0207081 | A1 | 8/2010 | Liou | |
| 2010/0314593 | A1 | 12/2010 | Fan | |

* cited by examiner

TOOL WITH WORKING AND POSITIONING DEVICES

CROSS REFERENCE TO RELATED APPLICATION

The present application is a continuation-in-part application of U.S. patent application Ser. No. 12/371,648 filed on Feb. 16, 2009, of which the entire disclosure is incorporated herein.

BACKGROUND OF THE INVENTION

1. Field of the Invention

The present invention relates to a tool having a working device adapted for pulling and prying an element to be pried and a positioning device adapted for positioning the working device at various angles with respect to a handle of the tool.

2. Description of the Related Art

A tool, generally known as a crowbar, includes a straight bar and a working end slightly bent with respect to the bar and forked. In operation, the working end is engaged with an element to be extracted and the straight bar is used as a lever to pivot about a fulcrum.

However, the working end is usually fixed to the straight bar and cannot be adjustably connected to the straight bar at various angles. It's not convenient to be used in various slopes. The present invention is, therefore, intended to obviate or at least alleviate the problems encountered in the prior art.

SUMMARY OF THE INVENTION

According to the present invention, a tool with working and positioning devices includes a handle, a working device, a positioning device, a clamping device, and a fine adjustment mechanism. The handle includes a pivotal end and a grip end. The pivotal end has a through-hole. The handle further includes a plurality of retaining sections disposed one after another. The working device has first and second ends. The first end of the working device is pivotally connected to the pivotal end of the handle and includes a positioned hole formed transversely and a cavity formed longitudinally and communicating with the positioned hole. The positioned hole corresponds to the through-hole. The positioning device is disposed at the through-hole, the positioned hole and the cavity and moveable between a fixing position and an adjusting position. The clamping device is adjustably positioned on the handle. The fine adjustment mechanism for fine adjusting the clamping device is adjustably positioned on the handle and engaged with the clamping device. The fine adjustment mechanism includes at least one positioning unit alternatively engaged with a selective one of the plurality of retaining sections to fix the clamping device to the handle in position.

While the positioning device is in the fixing position, the handle is fixed in position with respect to the working device. While the positioning device is in the adjusting position, the handle is able to pivot with respect to the working device, The clamping device is adapted to be fine adjustably moved through a distance smaller than a pitch between two adjacent retaining sections.

It is an aspect of the present invention that the tool has a simple structure and is manufactured cost-effectively.

It is another aspect of the present invention that the clamping device is adapted to be fine adjustably moved through a distance smaller than a pitch between two adjacent retaining sections.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

DETAILED DESCRIPTION OF THE INVENTION

Figure 1:
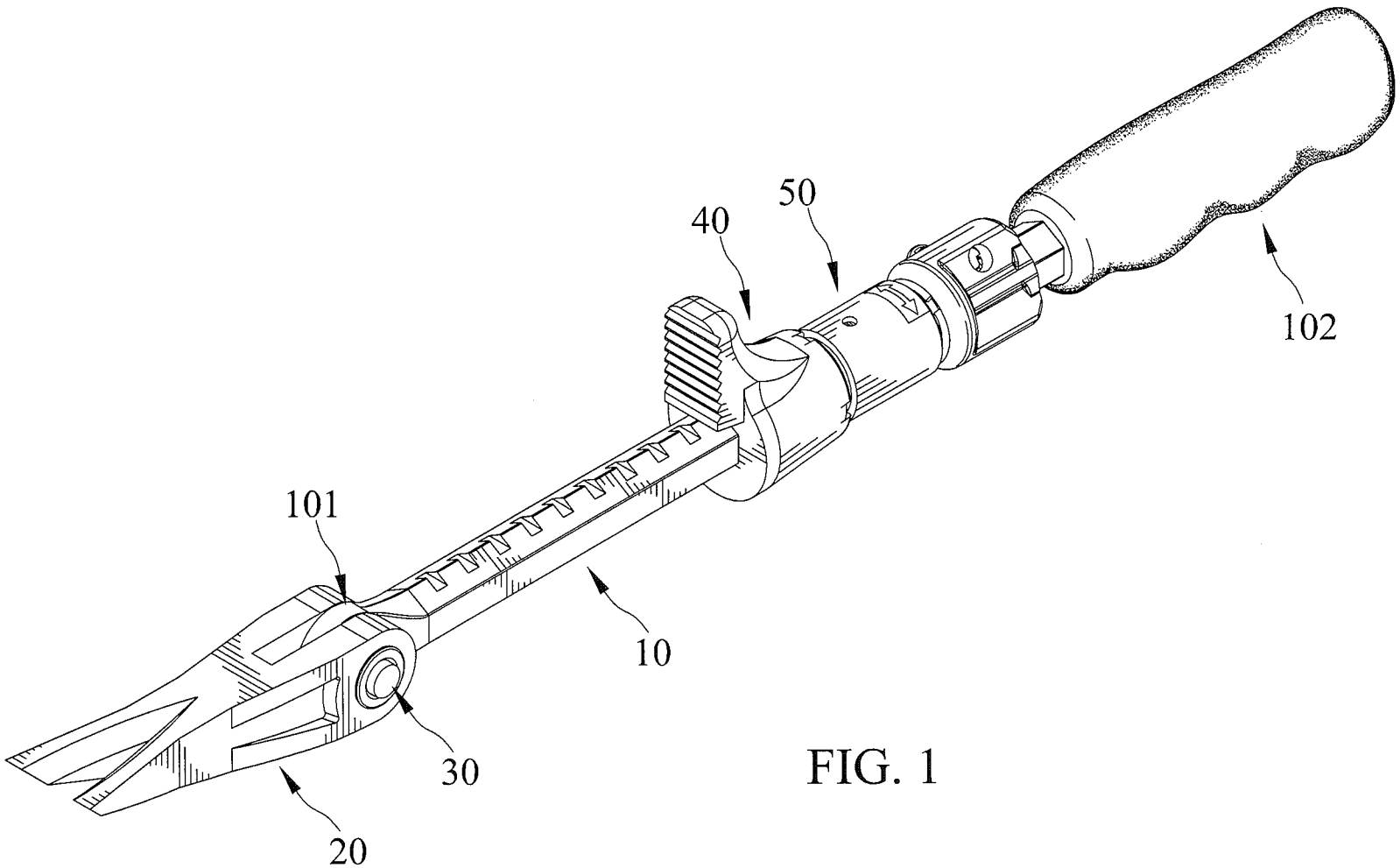
FIG. 1 is a perspective view of a tool with working and positioning devices of the present invention.
Figure 2:
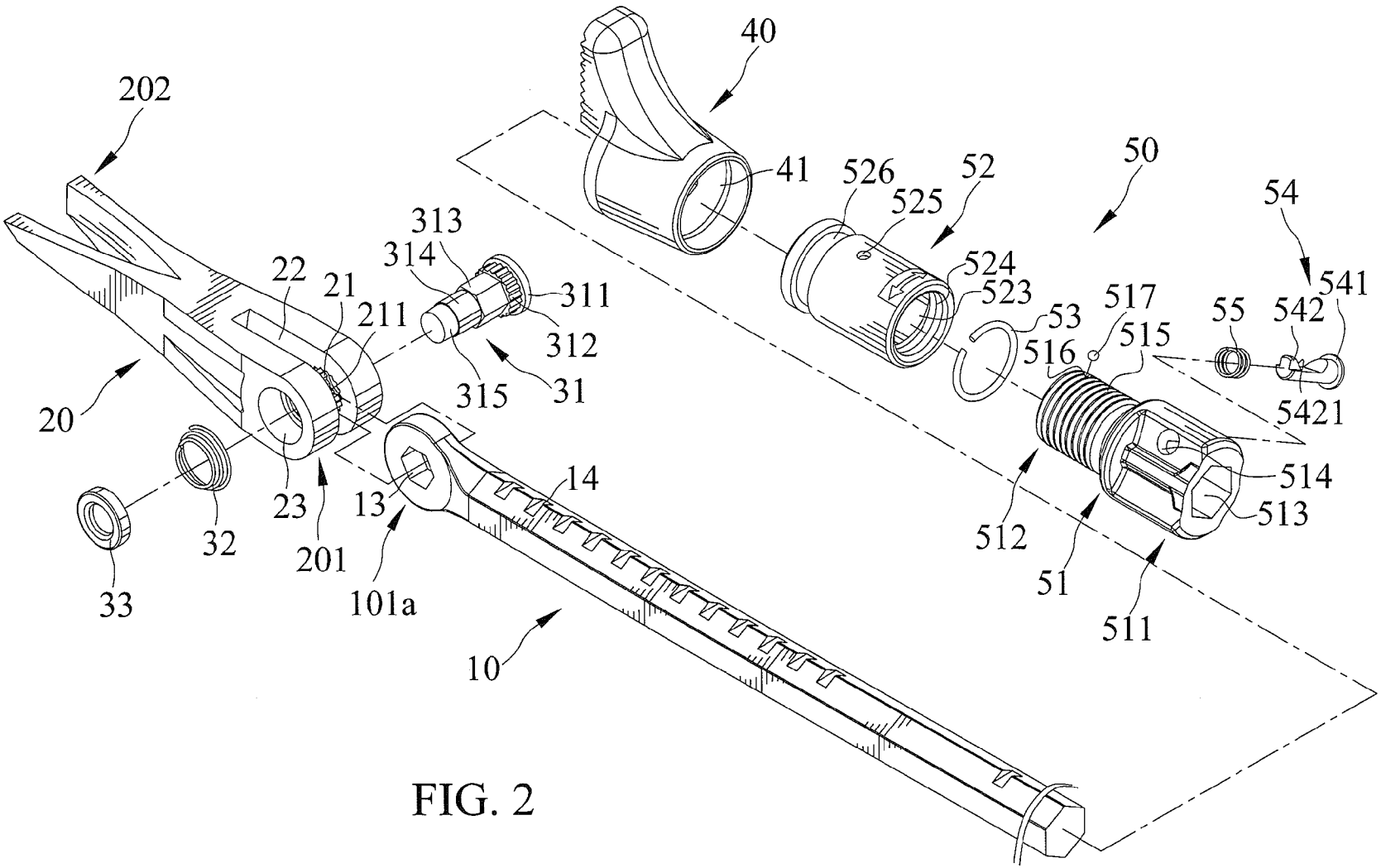
FIG. 2 is an exploded perspective view of the tool with working and positioning devices shown in FIG. 1.
Figure 3:
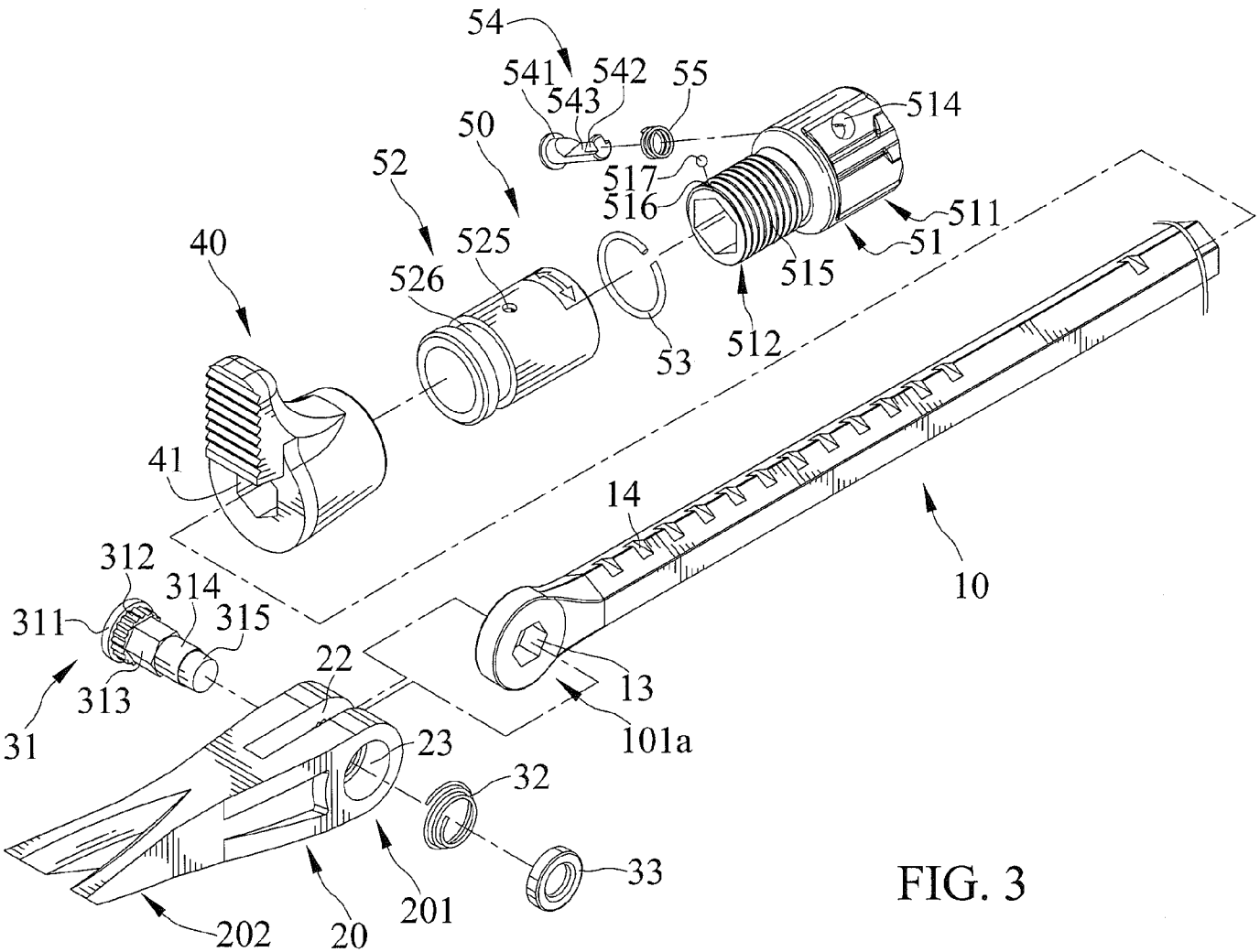
FIG. 3 is another exploded perspective view of the tool with working and positioning devices shown in FIG. 1.
Figure 4:
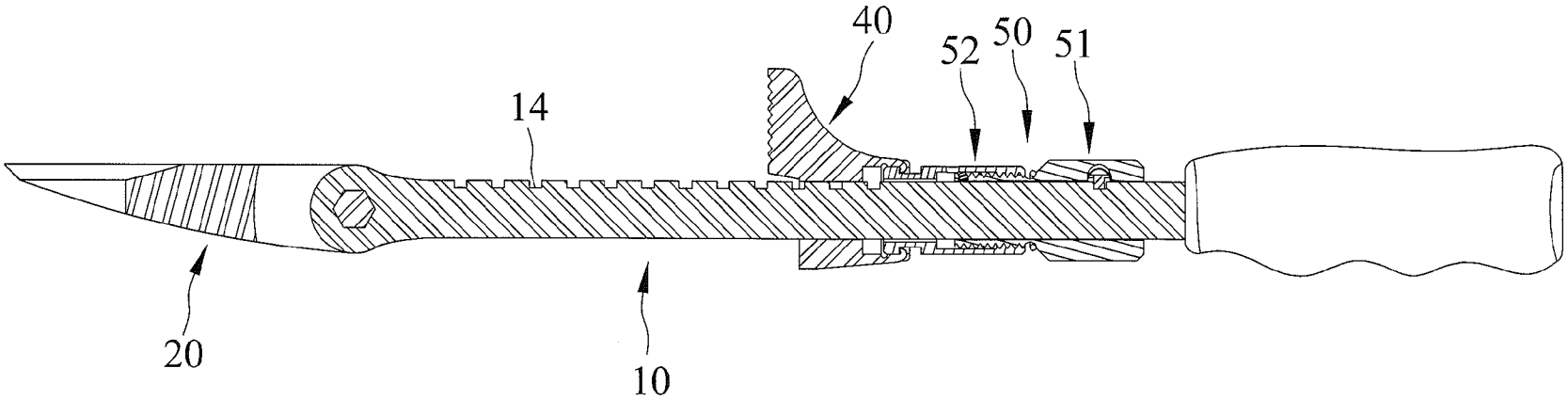
FIG. 4 is a cross-sectional view of the tool with working and positioning devices shown in FIG. 1.
Figure 5:
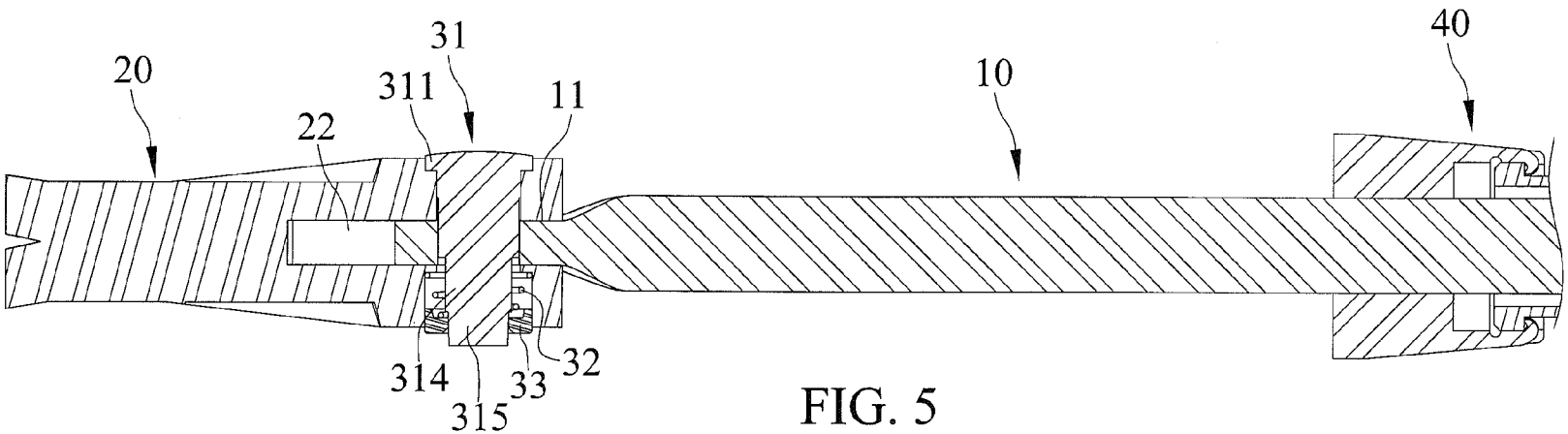
FIG. 5 is another cross-sectional view of the tool with working and positioning devices shown in FIG. 1 and shows a positioning device in a fixing position.
Figure 6:
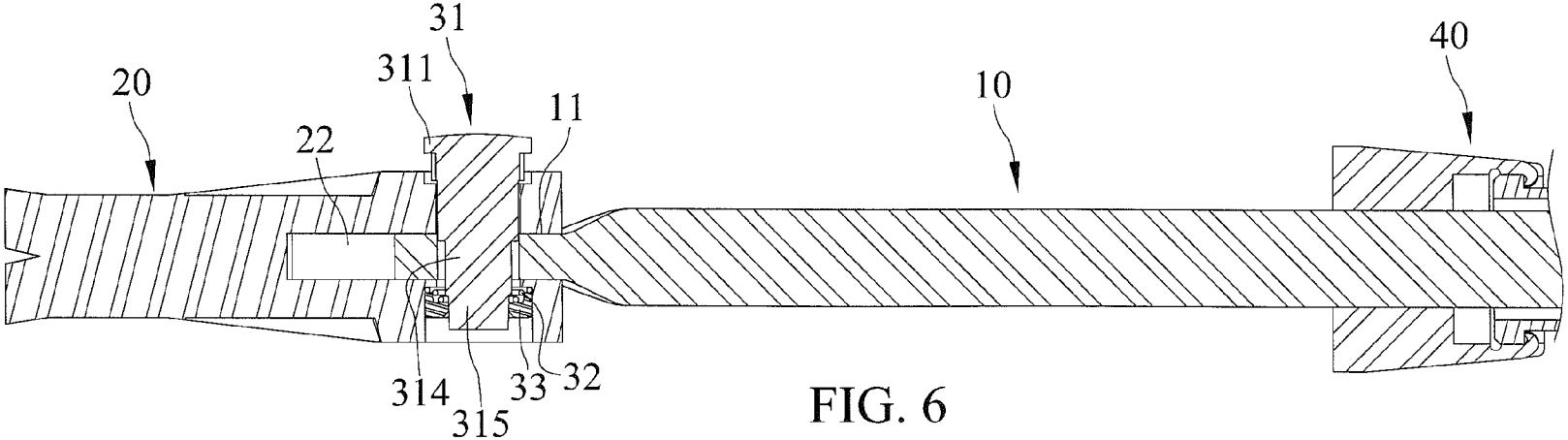
FIG. 6 is a cross-sectional view similar to FIG. 5, but shows the positioning device in an adjusting position.
Figure 8:
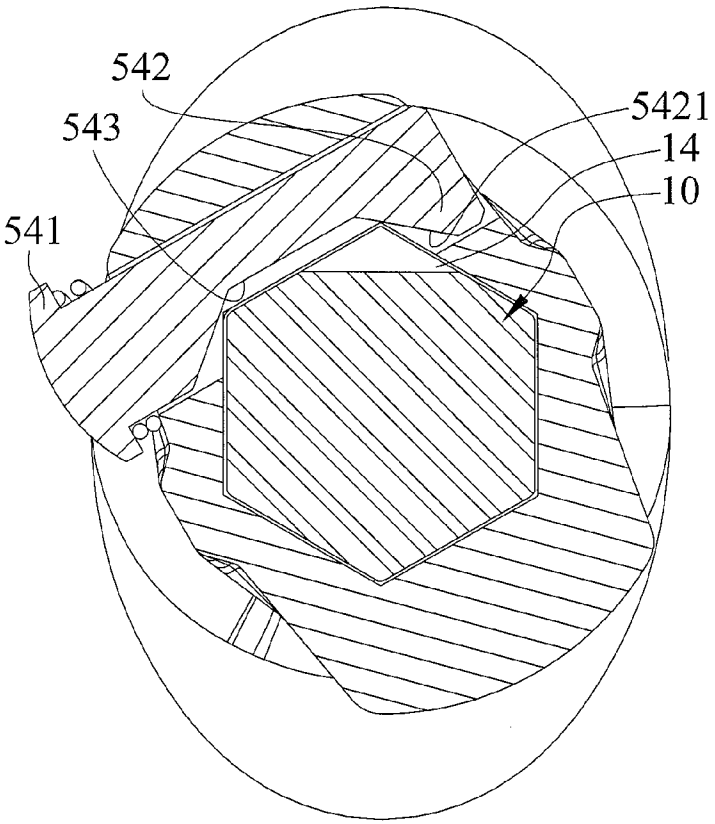
FIG. 8 is a cross-sectional view similar to FIG. 7, but shows the positioning unit in a disengaging position from the retaining section.
Figure 7:
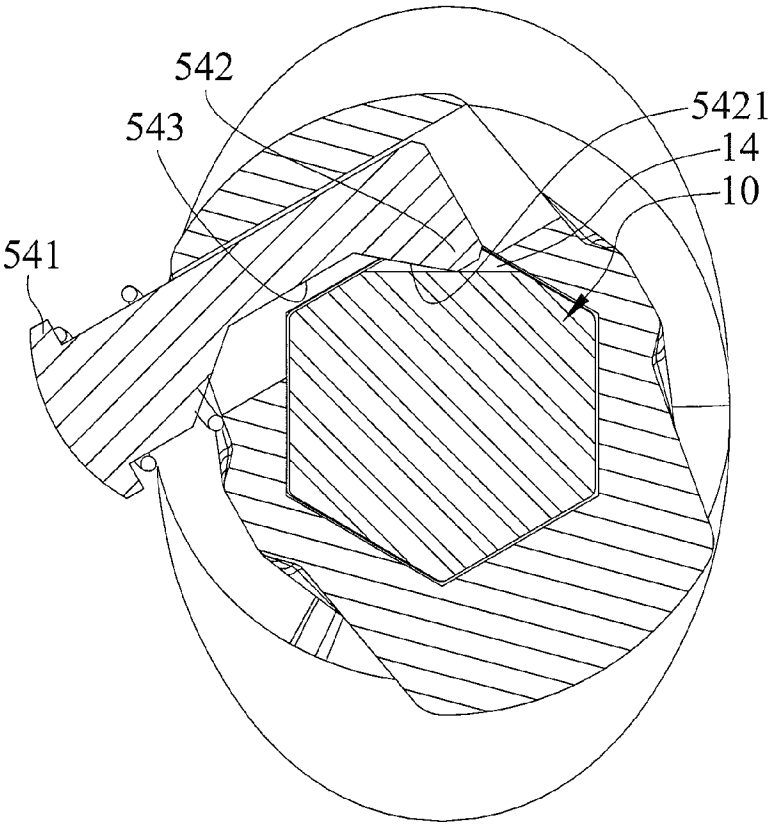
FIG. 7 is another cross-sectional view of the tool with working and positioning devices shown in FIG. 1 and shows a positioning unit in an engaging position with a retaining section defined on a handle.
Figure 9:
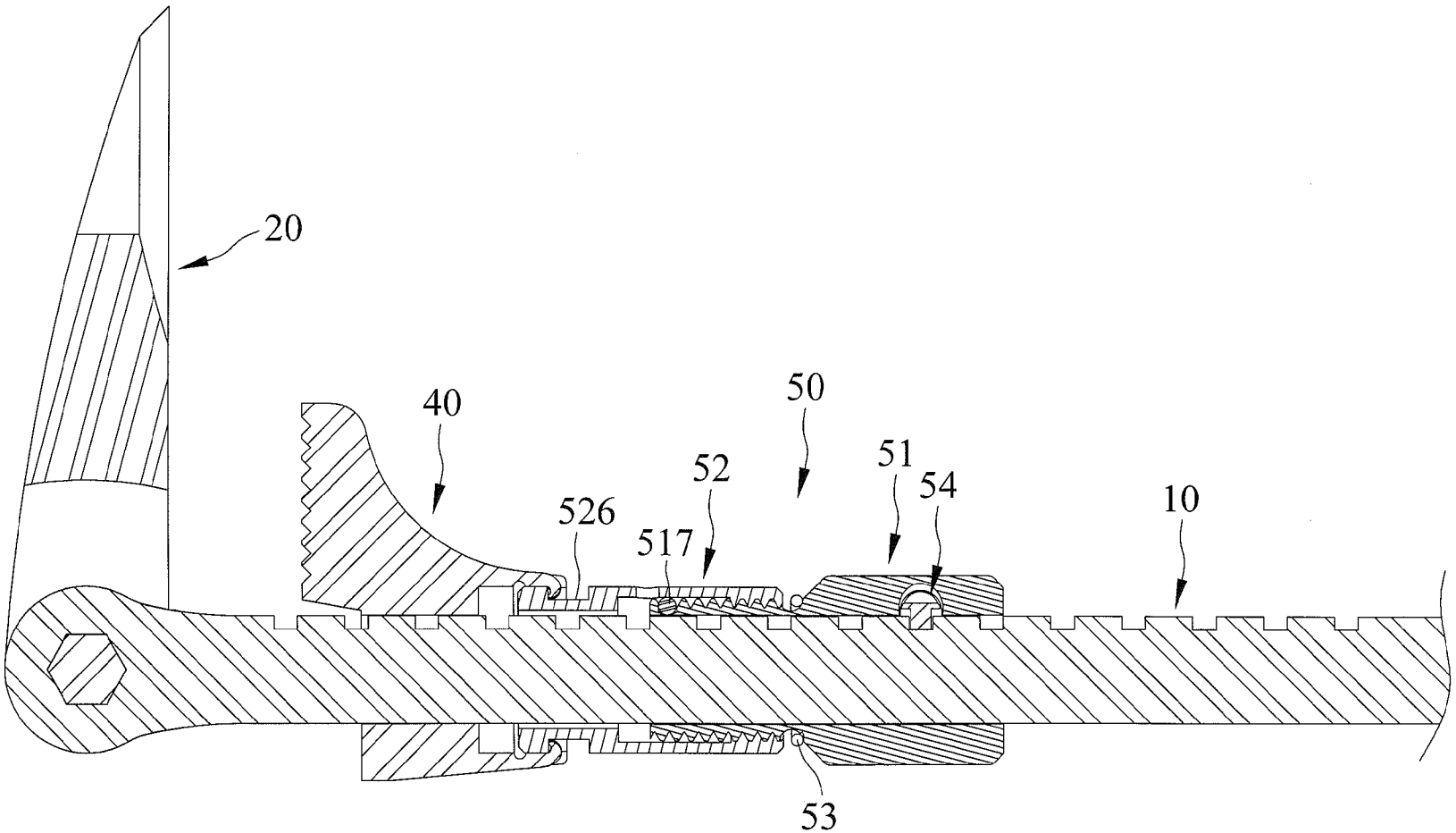
FIG. 9 is another cross-sectional view of the tool with working and positioning devices shown in FIG. 1.

FIGS. 1 through 7 show a tool usable for prying in accordance with a first embodiment of the present invention. The tool includes a handle 10*a*, working device 20, a positioning device 30, a clamping device 40, and a fine adjustment mechanism 50.

The positioning device 30 is moveable between a fixing position and an adjusting position. While the positioning device 30 is in the fixing position, the handle 10*a* is fixed in position with respect to the working device 20. While the positioning device 30 is in the adjusting position, the handle 10 is able to pivot with respect to the working device 20.

The handle 10 includes a pivotal end 101 and a grip end 102. A flat coupled portion 11 is defined at the pivotal end 101. The coupled portion 11 includes a hexagonal through-hole 13 transversely formed thereon. The handle 10 also includes the outer periphery including a plurality of retaining sections 14. The plurality of retaining sections 14 is disposed one after another and arranged in line and along a longitudinal length of the handle 10. Also, each of the plurality of retaining sections 14 is equally spaced.

The working device 20 includes first and second ends 201 and 202. The second end 202 is in the form of a pry. A positioned hole 21, a slot 22 and a cavity 23 are formed at the first end 201 and communicate with one another in sequence. The slot 22, which is sandwiched between the positioned hole 21 and the cavity 23 and extends from the first end 201 to the second end 202, is mounted on the pivotal end 101 of the handle 10. The positioned hole 21 corresponds to the through-hole 13 and has a plurality of positioning sections 211 defined on the periphery thereof to form the positioned hole 21 to be a ratchet hole preferably. In this case, the cavity 23 is in the form of a circle hole. Moreover, in other embodiments, attachment of the handle 10 and the working device 20 can be achieved via the coupled portion 11 mounted on the first end 201 of the working device 20.

The positioning device 30 is disposed at the through-hole 13, the positioned hole 21 and the cavity 23 and consists of a controller 31, a resilient member 32 and a retaining member 33. The controller 31 includes a cap 311, a plurality of detents 312, first and second body sections 313, 314 and a joint 315. The controller 31 is inserted through the pivotal end 101 and adapted to connect the working device 20 to the handle 10. The cap 311 is exposed from the positioned hole 21, and the plurality of detents 312 are removably meshed with the plurality of positioning sections 211. The first body section 313 is adjacent to the cap 311 and has a hexagonal cross-section to correspond to and engage with the trough-hole 13. The second body section 314 is adjacent to the joint 315 and inserted through the resilient member 32 in the cavity 23. The joint 315 is attached to the retaining member 33 in an adhesive manner or a screw manner for preventing removal of the controller 31 from the working device 20.

While the positioning device 30 is in the fixing position, the detents 312 are engaged with the positioning sections 211 of the working device 20. Thus, the handle 10 is fixed with respect to the working device 20. The profile of the first body section 313 corresponds to that of the through-hole 13, so that the controller 31 cannot rotate with respect to the handle 10*a*. The resilient member 32 and the retaining member 33 are limited in the cavity 23, and the positioning device 30 is restricted at the handle 10 and working device 20 via the cap 311 and the retaining member 33.

While the positioning device 30 is in the adjusting position, the handle 10 is able to rotate with respect to the working device 20. Users push the retaining member 33 of the positioning device 30 to press the resilient member 32 and to further press the controller 31. Then, the detents 312 are disengaged from the positioning sections 211 of the positioned hole 21. Therefore, users can adjust the working device 20 to a desired angle with respect to the handle 10. After adjustment, the retaining member 33 is released to return the positioning device 30 to be in the fixing position.

The clamping device 40 is adjustably positioned on the handle 10. The clamping device 40 is disposed non-rotatably with respect to the handle 10. The clamping device 40 can cooperate with the working device 20 to hold an item in a space therebetween. The clamping device 40 includes a receptacle 41 extended therein. The handle 10 is inserted through the receptacle 41, and the receptacle 41 includes a length having a cross section the same to the handle 10.

The fine adjustment mechanism 50 is engaged with the clamping device 40 for fine adjusting the clamping device 40. The clamping device 40 is adapted to be fine adjustably moved through a distance smaller than a pitch between two adjacent positioned sections 14. The fine adjustment mechanism 50 is mounted on the handle 10. The fine adjustment mechanism 50 includes first and second engaging members 51 and 52. The first engaging member 51 includes a first end 511, a second end 512, and a first hole 513 extended therethrough and from the first end 511 to the second end 512. The second engaging member 52 is rotatably engaged with the first engaging member 51 and interconnects the first engaging member 51 and the clamping device 40. The first and second engaging members 51 and 52 are threadly engaged with each other. The first engaging member 51 includes an outer peripheral wall including an outer thread 515. The second engaging member 52 includes an inner thread 524 engaged with the outer thread 515. The second engaging member 52 includes a first end 521, a second end 522, and a second hole 523 extended therethrough and from the first end 521 to the second end 522. Additionally, the handle 10 is inserted through the first and second engaging members 51 and 52. The handle 10 is inserted through the first engaging member 51 through the first hole 513. Likewise, the handle 10 is inserted through the second engaging member 52 through the second hole 523. Additionally, the inner thread 524 is defined on an periphery of the second hole 523. Moreover, the fine adjustment mechanism 50 includes the at least one bore 514 transversely extended therein. The bore 514 is extended in the first engaging member 51. The first engaging member 51 also includes the outer peripheral wall including a recess 516 extended radially therein. The second engaging member 52 includes an aperture 525 extended radially therethrough and connected with the second hole 523. A stopper 517 is insertable through the aperture 525 and disposed in the recess 516 and enclosed by the second engaging member 52. The stopper 517 has a spherical shape. Further, a ring 53 is disposed on the outer peripheral wall of the first engaging member 51 and reduces a travel length of the second engaging member 52 with respect to the first engaging member 51 and stops a relative movement of the first and second engaging members 51 and 52 to prevent disassembly of the stopper 517 from the fine adjustment mechanism 50 from the aperture 525. The second engaging member 52 includes a groove 526 including an end of clamping device 40 latched thereon to prevent disengagement between the second engaging member 52 and the clamping device 40. At least one positioning unit 54 is disposed in at least one bore 514, which is transversely extended in the fine adjustment mechanism 50, to selectively engage with one of the retaining sections 14 for fixing the clamping device 40 on the desired location of the handle 10. The at least one positioning unit 54 is in form of a column. The at least one positioning unit 54 includes a first end defining a flange 541 and a second end defining a protrusion 542 for inserting into one of the position sections 14. An abutted surface 5421 is defined on a side of the protrusion 542 such that the protrusion 542 inserted in one of the position sections 14 includes the abutted surface 5421 abutted against an inner wall of the position section 14 for a secure engagement between the clamping device 40 and the handle 10. A sunken portion 543 is provided between the first and second ends of the at least one positioning unit 54. The sunken portion 543 facilitates avoidance of the handle 10 interfering the at least one positioning unit 54 when the at least one positioning unit 54 is disengaged from any of the plurality of retaining section 14. The at least one positioning unit 54 further includes an elastic element 55 mounted thereon and adjacent to the flange 31. When the at least one positioning unit 54 is in an engaging position, the elastic element 55 is released, and the protrusion 542 is engaged with one of the retaining sections 14 and includes the abutted surface 5421 abutting against the inner wall of the retaining section 14. When the at least one positioning unit 54 is in a disengaging position, the elastic element 55 is pressed, and the protrusion 542 is disengaged from the retaining section 14 and includes the abutted surface 34 spaced from the inner wall of the located groove 13. Therefore, when the at least one positioning unit 54 is in the disengaging position, the clamping device 40 can slide relative to the handle 10; when the at least one positioning unit 54 is in the engaging position, the location of the clamping device 40 on the handle 10 is fixed. Additionally, the clamping device 40 and the fine adjustment mechanism 50 are disposed adjacent to the grip end 102 of the handle 10 when in an original position in which the clamping device 40 is not in use.

Figure 10:
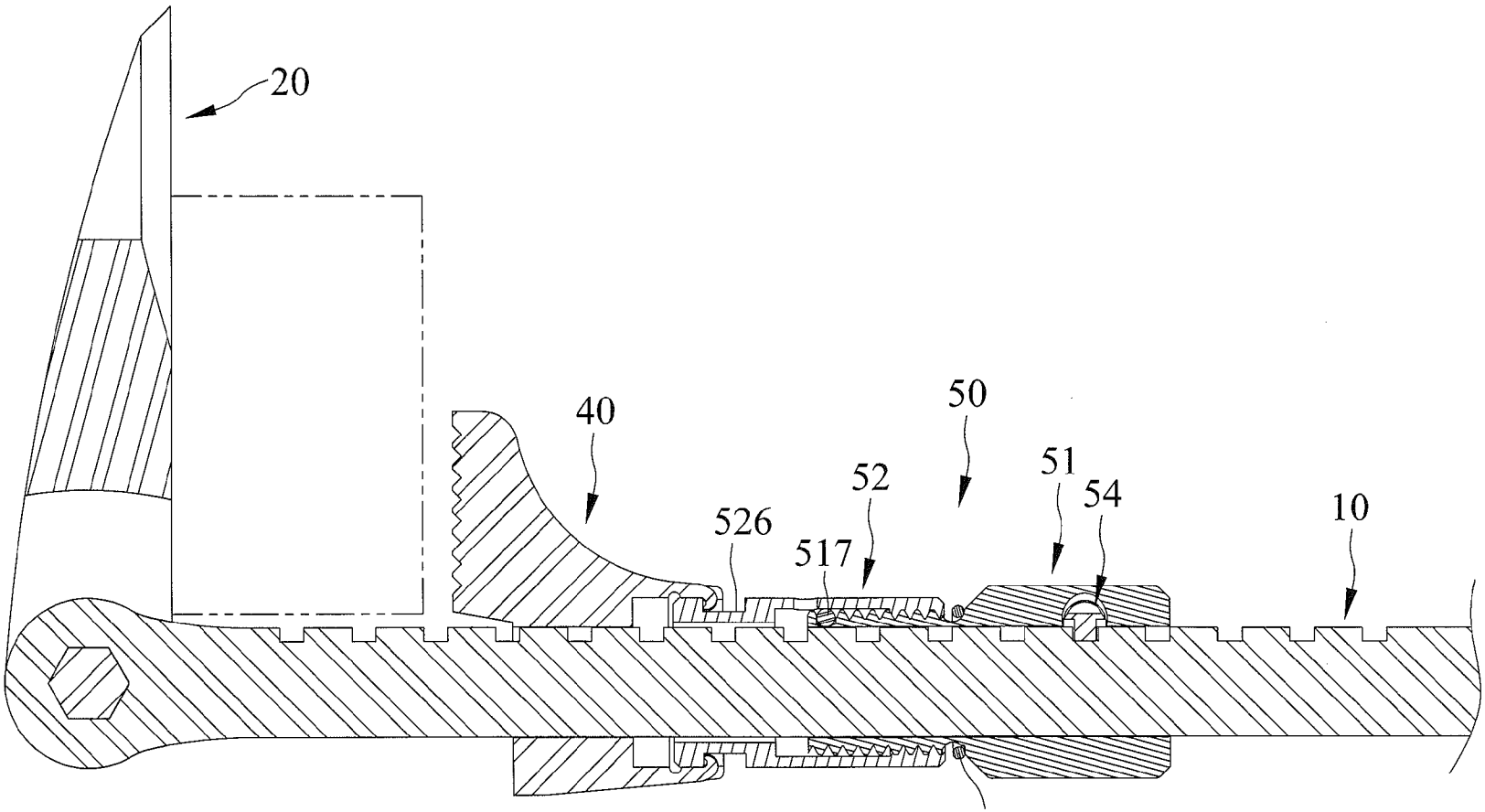
FIG. 10 illustrates an object to be held between a working device and a clamping device disposed therebetween, yet not securely.
Figure 11:
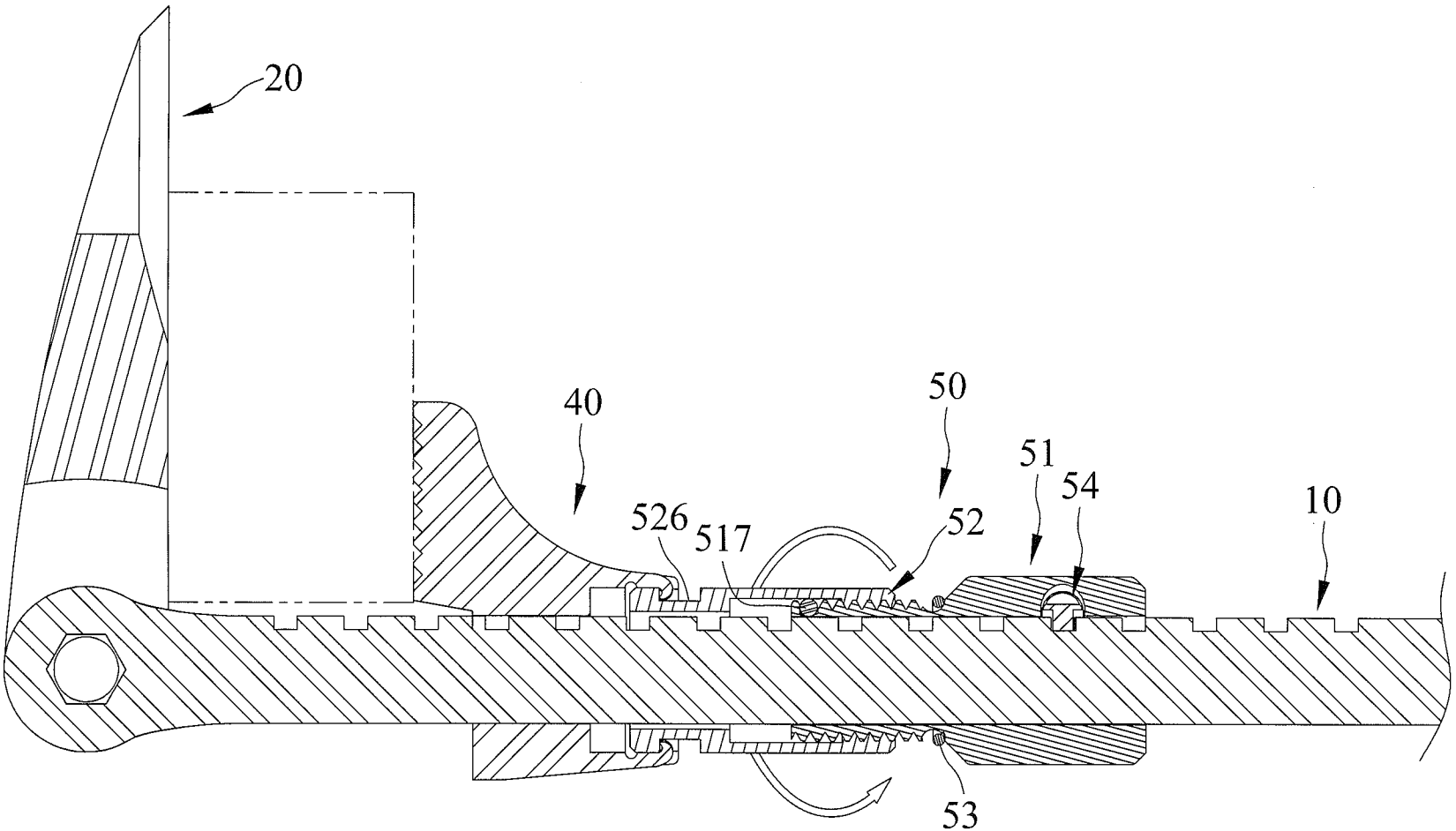
FIG. 11 is a continued view of FIG. 10 and illustrates the operation of a fine adjustment mechanism to move the clamping device to a position that the object is able to be securely held between the working device and the clamping device.

FIG. 10 shows the clamping device 40 is fixed with respect to the handle 10 as the fine adjustment mechanism 50 includes the at least one positioning unit 54 in the engaging position, with the protrusion 542 engaged with one of the retaining sections 14. Additionally, an element is disposed in a space between the working device 20 and the clamping device 40, and the clamping device 40 is in a position that is not abutted against the element. Therefore, the clamping device 40 needs to be moved to a position that is abutted against the element for securely holding the element. Nevertheless, the clamping device 40 can not fixedly position with respect to the handle 10 when in the position that is abutted against the element as the least one positioning unit 54 is not in a position that can engage with any one of the retaining sections 14. In this regard, the fine adjustment mechanism 50 can be operated in a manner that the at least one positioning unit 54 is maintained in engagement with the currently engaged retaining section 14 and that the second engaging member 52 is operably moved with respect to the first engaging member 51 to cause the clamping device 40 to slide along the handle 10 to the position that is abutted against the element, as shown in FIG. 11. The first engaging member 51 is fixed with respect to the handle 10 when the at least one positioning unit 54 is maintained in engagement with the currently engaged retaining section 14. Additionally, the second engaging member 52 is rotated with respect to the first engaging member 51 to move linearly along the handle 10.

In view of the forgoing, the clamping device 40 can be fine adjusted by the fine adjustment mechanism 50. In this regard, the clamping device 40 can be fine adjustably moved through a distance smaller than a pitch between two adjacent retaining sections 14.

While the specific embodiment has been illustrated and described, numerous modifications come to mind without significantly departing from the spirit of invention, and the scope of invention is only limited by the scope of the accompanying claims.

What is claimed is:

1. A tool with working and positioning devices comprising:

a handle including a pivotal end and a grip end, with the pivotal end having a through-hole, and including a plurality of retaining sections disposed one after another;

a working device having first and second ends, with the first end of the working device pivotally connected to the pivotal end of the handle and including a positioned hole formed transversely and a cavity formed longitudinally and communicating with the positioned hole, with the positioned hole corresponding to the through-hole;

a positioning device disposed at the through-hole, the positioned hole and the cavity and moveable between a fixing position and an adjusting position;

a clamping device adjustably positioned on the handle; and a fine adjustment mechanism for fine adjusting the clamping device adjustably positioned on the handle and engaged with the clamping device and including at least one positioning unit alternatively engaged with a selective one of the plurality of retaining sections to fix the clamping device to the handle in position;

wherein while the positioning device is in the fixing position, the handle is fixed in position with respect to the working device; wherein while the positioning device is in the adjusting position, the handle is able to pivot with respect to the working device; and wherein the clamping device is adapted to be fine adjustably moved through a distance smaller than a pitch between two adjacent retaining sections.

2. The tool with working and positioning devices as claimed in claim 1, wherein the positioned hole has a periphery including plurality of positioning sections to form the positioned hole to be a ratchet hole.

3. The tool with working and positioning devices as claimed in claim 1, wherein the positioning device includes a controller, a resilient member, and a retaining member, wherein the controller includes a plurality of detents and a first body section corresponding to and engaging with the trough-hole of the handle, wherein the positioned hole includes a plurality of positioning sections defined on the periphery thereof, with the plurality of detents removably meshed with the plurality of positioning sections, wherein the resilient and retaining members are disposed in the cavity, wherein the controller is inserted through the resilient member and coupled to the retaining member.

4. The tool with working and positioning devices as claimed in claim 3, wherein the fine adjustment mechanism includes first and second engaging members engaged with each other, wherein the second engaging member interconnects the first engaging member and the clamping device.

5. The tool with working and positioning devices as claimed in claim 4, wherein the first and second engaging members are rotatably engaged with each other.

6. The tool with working and positioning devices as claimed in claim 4, wherein the first engaging member includes an outer peripheral wall including a recess extended raidally therein, wherein the second engaging member includes an aperture extended radially therethrough, wherein a stopper is inserted through the aperture and disposed in the recess and enclosed by the second engaging member, wherein a ring is disposed on the outer peripheral wall of the first engaging member to reduce a travel length of the second engaging member with respect to the first engaging member and to stop a relative movement of the first and second engaging members to prevent disassembly of the stopper from the aperture.

7. The tool with working and positioning devices as claimed in claim 3, wherein the at least one positioning unit includes an end having a side including a protrusion, wherein the protrusion is inserted into a selective one of the position sections and includes and an abutted surface abutting against an inner wall of the position section for a secure engagement between the clamping device and the handle.

8. The tool with working and positioning devices as claimed in claim 7, wherein the at least one positioning unit includes a sunken portion facilitating avoidance of the handle interfering the at least one positioning unit when the at least one positioning unit is disengaged from any of the plurality of retaining section.

9. The tool with working and positioning devices as claimed in claim 1, wherein the clamping device is disposed non-rotatably with respect to the handle.

10. The tool with working and positioning devices as claimed in claim 1, wherein the fine adjustment mechanism includes first and second engaging members engaged with each other, wherein the second engaging member interconnects the first engaging member and the clamping device.

11. The tool with working and positioning devices as claimed in claim 10, wherein the first and second engaging members are rotatably engaged with each other.

12. The tool with working and positioning devices as claimed in claim 11, wherein the first and second engaging members are threadly engaged with each other.

13. The tool with working and positioning devices as claimed in claim 10, wherein the first engaging member includes the at least one second receptacle transversely extended therein, wherein the at least one positioning unit is disposed in at least one second receptacle.

14. The tool with working and positioning devices as claimed in claim 10, wherein the first engaging member includes an outer peripheral wall including a recess extended raidally therein, wherein the second engaging member includes an aperture extended radially therethrough, wherein a stopper is inserted through the aperture and disposed in the recess and enclosed by the second engaging member, wherein a ring is disposed on the outer peripheral wall of the first engaging member to reduce a travel length of the second engaging member with respect to the first engaging member and to stop a relative movement of the first and second engaging members to prevent disassembly of the stopper from the aperture.

15. The tool with working and positioning devices as claimed in claim 10, wherein the second engaging member includes a groove including an end of clamping device latched thereon to prevent disengagement between the second engaging member and the clamping device.

16. The tool with working and positioning devices as claimed in claim 1, wherein the at least one positioning unit includes an end having a side including a protrusion, wherein the protrusion is inserted into a selective one of the position sections and includes an abutted surface abutting against an inner wall of the position section for a secure engagement between the clamping device and the handle.

17. The tool with working and positioning devices as claimed in claim 16, wherein the at least one positioning unit includes a sunken portion facilitating avoidance of the handle interfering the at least one positioning unit when the at least one positioning unit is disengaged from any of the plurality of retaining section.

18. The tool with working and positioning devices as claimed in claim 17, wherein the at least one positioning unit includes an elastic element, wherein the elastic element is released when the at least one positioning unit including the protrusion engaged with any one of the plurality of position sections, wherein the elastic element is pressed when the at least one positioning unit including the protrusion disengaged from any one of the plurality of position sections.

19. The tool with working and positioning devices as claimed in claim 1, wherein cooperation of the working device and the clamping device is able to clamp materials with various sizes.

20. The tool with working and positioning devices as claimed in claim 1, wherein the clamping device and the fine adjustment mechanism are disposed adjacent to the grip end of the handle when in an original position in which the clamping device is not in use.

* * * * *